US008544231B2

(12) United States Patent
Hannig

(10) Patent No.: US 8,544,231 B2
(45) Date of Patent: Oct. 1, 2013

(54) PLASTIC PANEL HAVING A HOOK-TYPE PROFILE

(75) Inventor: Hans-Juergen Hannig, Bergisch Gladbach (DE)

(73) Assignee: Akzenta Paneele & Profile GmbH, Kaisersesch (DE)

( * ) Notice: Subject to any disclaimer, the term of this patent is extended or adjusted under 35 U.S.C. 154(b) by 0 days.

(21) Appl. No.: 13/022,758

(22) Filed: Feb. 8, 2011

(65) Prior Publication Data

US 2011/0131909 A1 Jun. 9, 2011

Related U.S. Application Data

(63) Continuation of application No. PCT/EP2009/059486, filed on Jul. 23, 2009.

(30) Foreign Application Priority Data

Aug. 8, 2008 (DE) ..... 20 2008 010 555 U

(51) Int. Cl.
*E04B 2/00* (2006.01)
*E04B 2/08* (2006.01)

(52) U.S. Cl.
USPC ..... 52/588.1; 52/589.1; 52/592.1

(58) Field of Classification Search
USPC ..... 52/309.15, 578, 588.1, 582.1, 589.1, 52/592.1
See application file for complete search history.

(56) References Cited

U.S. PATENT DOCUMENTS 890,436 A * 6/1908 Momberg ..... 52/506.01
6,345,481 B1 * 2/2002 Nelson ..... 52/592.2
6,385,936 B1 * 5/2002 Schneider ..... 52/589.1
6,584,747 B2 * 7/2003 Kettler et al. ..... 52/592.2
7,926,234 B2 * 4/2011 Pervan et al. ..... 52/390
2003/0145549 A1 * 8/2003 Palsson et al. ..... 52/589.1
2004/0123547 A1 * 7/2004 Grafenauer ..... 52/578

(Continued)

FOREIGN PATENT DOCUMENTS

DE 29908733 U1 9/1999
DE 20021677 U1 3/2001

(Continued)

OTHER PUBLICATIONS

PCT International Preliminary Report on Patentability Dated Feb. 21, 2011 (8 Pages).

*Primary Examiner* — Ryan Kwiecinski
(74) *Attorney, Agent, or Firm* — Lucas & Mercanti, LLP

(57) ABSTRACT

The invention relates to a floor panel (1) which is designed as a multi-ply laminate and comprises at least one plastic support (30), a décor layer (31) applied to a top face of the plastic support, a transparent covering (32) applied to the décor layer, and a backing layer (33) applied to the lower face of the elastic support, the panel having pairs of opposite lateral edges (3, 4; 5, 6) comprising complementary holding profiles. The holding profiles of at least one of the two lateral edge pairs are designed as form-locking complementary hook-type profiles and comprise a receiving hook (9) which faces the top face (2) of the floor panel, and a locking hook (10) arranged on the opposite lateral edge, which faces the lower face (7) of the floor panel. The locking hook (10) comprises a snap-in element (12, 13, 14) on a distal lateral face (11), said snap-in element being associated with a complementary snap-in element (22, 23, 21) on a proximal lateral face (20) of the hook profile having the receiving hook.

17 Claims, 4 Drawing Sheets

(56) References Cited

U.S. PATENT DOCUMENTS

Figure 1:
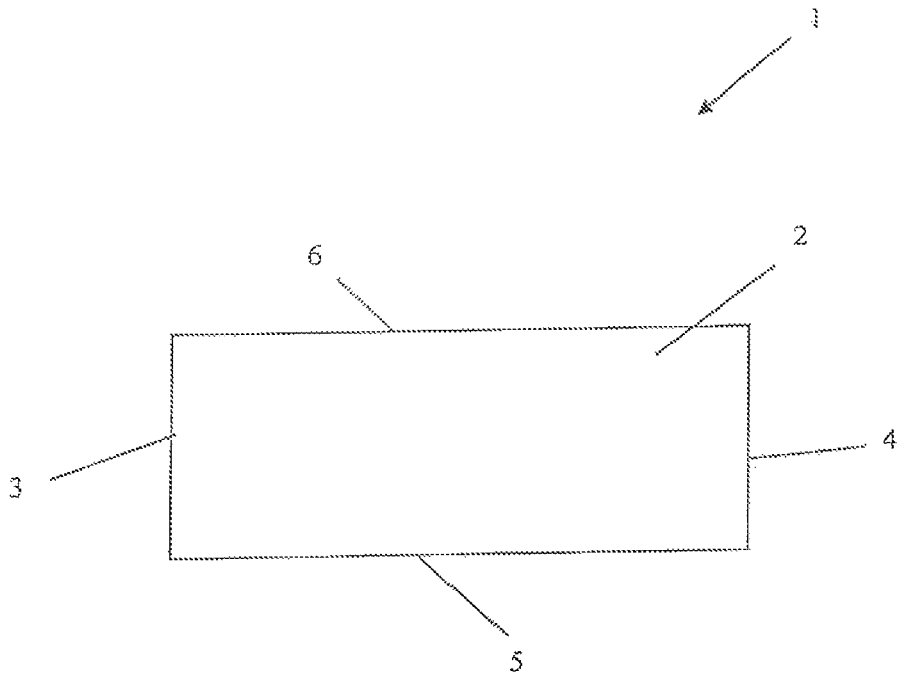

| | | | | |
|---|---|---|---|---|
| 2004/0128934 | A1* | 7/2004 | Hecht | 52/578 |
| 2004/0250492 | A1* | 12/2004 | Becker | 52/578 |
| 2005/0050827 | A1 | 3/2005 | Schitter | |
| 2006/0024465 | A1* | 2/2006 | Briere | 428/60 |
| 2008/0000185 | A1* | 1/2008 | Duernberger | 52/578 |
| 2008/0138560 | A1 | 6/2008 | Windmoller | |
| 2009/0049787 | A1* | 2/2009 | Hannig | 52/589.1 |
| 2010/0218450 | A1* | 9/2010 | Braun et al. | 52/588.1 |
| 2011/0162312 | A1* | 7/2011 | Schulte | 52/578 |
| 2011/0185663 | A1* | 8/2011 | Martensson | 52/309.13 |
| 2012/0066996 | A1* | 3/2012 | Konstanczak | 52/588.1 |
| 2013/0036695 | A1* | 2/2013 | Durnberger | 52/309.3 |
| 2013/0097959 | A1* | 4/2013 | Michel | 52/588.1 |

FOREIGN PATENT DOCUMENTS

| | | | |
|---|---|---|---|
| DE | 19944399 | A1 | 4/2001 |
| DE | 20214532 | U1 | 3/2004 |
| DE | 10316886 | A1 | 10/2004 |
| DE | 202004014160 | U1 | 12/2004 |
| DE | 29724876 | U1 | 3/2005 |
| DE | 102004011531 | B3 | 11/2005 |
| DE | 102005023661 | A1 | 11/2006 |
| DE | 10 2005 028072 | | 12/2006 |
| DE | 102005028072 | A1 | 12/2006 |
| DE | 202007000310 | U1 | 5/2007 |
| DE | 102006058655 | A1 * | 6/2008 |
| EP | 698126 | A1 | 12/1994 |
| EP | 843763 | A1 | 12/1997 |
| EP | 890373 | A1 | 1/1999 |
| EP | 1024234 | A2 | 8/2000 |
| EP | 1036341 | A1 | 9/2000 |
| EP | 1262607 | B1 | 9/2004 |
| EP | 1036341 | B1 | 2/2005 |
| EP | 1512808 | A1 | 3/2005 |
| EP | 843763 | B2 | 11/2006 |
| EP | 1938963 | A1 | 12/2007 |
| EP | 1 938 963 | | 7/2008 |
| GB | 1430423 | A | 3/1976 |
| WO | 9428183 | A1 | 12/1994 |
| WO | 9747834 | A1 | 12/1997 |
| WO | 2002004206 | A1 | 1/2002 |
| WO | 02/31291 | | 4/2002 |
| WO | 2005010297 | A1 | 2/2005 |

* cited by examiner

PLASTIC PANEL HAVING A HOOK-TYPE PROFILE

This is a Continuation of PCT/EP2009/059486 filed Jul. 23, 2009 which in turn claimed the priority of German Patent Application No. 20 2008 010 555.2 filed Aug. 8, 2008, the priority of both Applications are claimed and both applications are incorporated by reference herein.

The invention relates to a floor panel according to the generic part of claim 1.

A floor panel of this kind is designed as a multi-ply laminate and is known, for example, from DE 10 2006 058 655 A1. In particular, it can be regarded as a replacement of conventional floor panels having holding profiles in which the core consists of an engineered wood product such as MDF or HDF, which is covered by a decorative layer and a top or wear layer, wherein the holding profiles on the lateral edges of the panel provide for the panel to be installed without adhesive and to be mutually supported in their mounted state in such a manner that a gap-free floor surface is produced. Compared thereto, the floor panel of the above kind has the advantage that the plastic core or carrier already provides a comparatively effective impact sound insulation, without requiring an additional impact sound insulation to be applied in any case to the lower face of the panel.

The panel described in DE 10 2006 058 655 A1 comprises holding profiles in the form of an undercut and hence lockable tongue-and-groove profile disposed on two opposite side edges. To guarantee that the installed panels remain reliably interlocked, undercuts are normally required which have dimensions that prevent an individual horizontal joining movement of the panels to each other in the installation plane which is to be performed for locking such panels. A so-called snap installation, in which the panels are interlocked by a purely horizontal joining movement, is not possible. Today, such panels having an undercut tongue-and-groove profile are instead locked in such a way that a panel to be installed is first placed against an already installed panel in an inclined position with respect to the already installed panel and thereafter pivoted downward to the plane of the already installed panel, thus producing and simultaneously locking the tongue-and-groove connection. If both pairs of opposite lateral edges are provided with such holding profiles in the form of an undercut tongue-and-groove profile, the panels must be very precisely guided during their assembly and locking, because otherwise they would become wedged.

The type-defining floor panel comprises a plastic support, e.g. made of PVC, polyolefin or polyurethane, which materials are relatively elastic and flexible compared to panels having a woodchip core, depending on the specific design. As a result, during the installation of the type-defining floor panel, the problem frequently arises that the panel is deformed due to the influence of external forces and that the complementary profiles become wedged, so that joining of the panels is at least made difficult.

In this respect, it is an object of the present invention to develop further a panel of the described type in such a manner that it can be easily installed while enabling a gap-free floor surface to be maintained.

This object is achieved in a surprisingly simple way by a floor panel which is designed as a multi-ply laminate and comprises at least one plastic support, a décor layer applied to a top face of the plastic support, a transparent covering layer applied to the décor layer, and possibly a backing layer applied to the lower face of the plastic support, the panels having pairs of opposite lateral edges each comprising complementary holding profiles.

If the plastic support of the panel of the invention comprises not only on its top face, but also on its lower face at least one layer, e.g. a backing layer that prevents arching of the panel as a result of layers on the top face, the plastic support acts as a plastic core that carries at least one additional layer on both major surfaces.

The floor panel according to the invention is characterized in that the holding profiles of at least one of the two pairs of lateral edges are designed as form-locking complementary hook-type profiles and comprise a receiving hook which faces the top face of the floor panel, and a locking hook arranged on the opposite lateral edge, which faces the lower face of the floor panel, the locking hook comprising a snap-in element on a distal lateral face, said snap-in element being associated with a complementary snap-in element on a lateral face of the hook profile having the receiving hook.

By the design of the panels in accordance with the invention, it is achieved that the panels at least at the lateral edge that is designed with a hook-type profile can be joined and locked to the complementary hook-type profile by a joining movement substantially vertically to the installation plane, which makes the installation much easier. By the fact that the locking hook itself is locked to a proximal lateral face of the adjacent panel, arching of the locking hook in the installed condition can be prevented, so that during the installation a flat panel surface is produced also at the connecting edges of adjacent panels.

The floor panel of the invention can be fabricated using a thermal laminating process. But in a special form it is also possible for the individual layers to be applied in the manner of a paint coat, with the plastic support being the starting point. Depending on the form of execution of the invention, the thickness of the floor panels of the invention amounts to 3-10 mm, preferably to 4-8 mm and most preferably to 5-6 mm. Depending on the specific structure, the mass per unit area of the panels is between 1-2.5 kg/m$^2$ thickness, preferably between 1.6 and 1.8 kg/m$^2$ per mm thickness.

The floor panel of the invention can be fabricated on the one side by applying the various layers for forming a laminate panel, which is subsequently sawed up into individual panel base bodies. In a subsequent working step, the respective holding profiles are machined at the lateral edges of the panel base bodies. Considering that the décor layer and the covering layer are very thin compared to the plastic support—together they are normally less than one tenth or even less than one fiftieth of the thickness of the plastic support—the locking hook is mainly formed by the material of the plastic core. If the floor panel of the invention does not comprise on its lower face an additional layer such as a backing layer, the receiving hook of the corresponding holding profile is entirely formed by the material of the plastic support.

Expediently, the receiving hook comprises on a distal lateral face a snap-in element that is associated with a complementary snap-in element on a proximal lateral face of the hook profile. Thus the hook profiles are lockable both distally and proximally.

The above-mentioned snap-in elements which are respectively arranged in a complementary fashion on the distal lateral faces of the hooks and on the proximal lateral faces of the profiles, can be designed for example as a locking protrusion or as a locking pocket receiving said locking protrusion. Besides, all other forms of locking elements known to the person skilled in the art can be used, provided that these locking elements are suitable to guarantee locking of the hook profiles.

Expediently, both the receiving hook and the locking hook each comprise an undercut surface that is effective as a mutual guide surface during the joining movement for producing a form-fit connection between the hook profiles, both undercut surfaces extending at an acute angle with respect to the vertical of the panel surface. This design measure simplifies the joining and locking process, since it provides contact and sliding surfaces.

To simplify the joining process even more, it can be provided that the receiving hook comprises on its distal lateral face a guide surface which is inclined with respect to the panel surface and which serves as a contact and sliding surface which during the joining movement for producing a form-fit connection between the complementary hook-type profiles cooperates with a complementary guide surface on a proximal lateral face of the locking hook profile of the panels. Here it is particularly advantageous if during the joining movement the contact surface on the receiving hook contacts the complementary contact surface first and before the co-action of the above-described respective undercut surfaces on the receiving hook and on the locking hook.

Expediently, the floor panel of the invention can comprise holding profiles in the form of hook-type profiles on all four lateral edges, i.e. on both pairs of lateral edges so that the floor panel of the invention is joined and locked by a substantially planar joining movement and a movement of the panel vertically to the installation plane.

Moreover, in can be provided by the invention that on one of the two pairs of lateral edges, particularly on the pair of the long lateral edges, an undercut groove-and-tongue profile is provided, whereas the holding profile on the pair of short lateral edges comprises complementary hook-type profiles.

Expediently, the panels of the invention can be installed in such a manner that a new panel is locked at one lateral edge thereof to a panel already installed in the installation plane, at the lateral edge of the installed panel including a holding profile that is formed complementary to the holding profile of the new panel, whereupon the new panel is placed with said lateral edge comprising its holding profile including the locking hook onto the holding profile including a receiving hook of the lateral edge of the already installed panel, so that a guide surface on the distal lateral face of the receiving hook of the already installed panel which is inclined with respect to the panel surface comes into contact with a complementary guide surface on a proximal side face of the hook-type profile of the new panel and, moreover, the locking hook is supported on the receiving hook and thereafter the new panel is displaced with said guide surface on its proximal side face along the guide surface on the distal side face of the receiving hook in an inclined fashion with respect to the panel surface, whereby the locking hook is pivotally moved out of the installation plane, so that an undercut surface on the locking hook comes into contact with an undercut surface on the receiving hook.

By applying a substantially vertical force on the surface of the new panel, the same can be displaced along its guide surface in an inclined fashion relative to, the already installed panel in the region of the holding profile, whereby the panels are forced toward each other.

In order to lock adjacent panels, it can provided that a force is applied on the locking hook approximately vertically to the panel surface, so that a snap-in element on a distal lateral face of the locking hook of the new panel co-acts in an interlocking fashion with a complementary snap-in element on a proximal lateral face of the receiving profile of the already installed panel in such a manner that the locking hook that has been pivotally moved out of the installation plane is pivoted back to and locked in the installation plane. During this process, a vertical force on the locking hook is produced using a pressure roller, for example.

Figure 3:
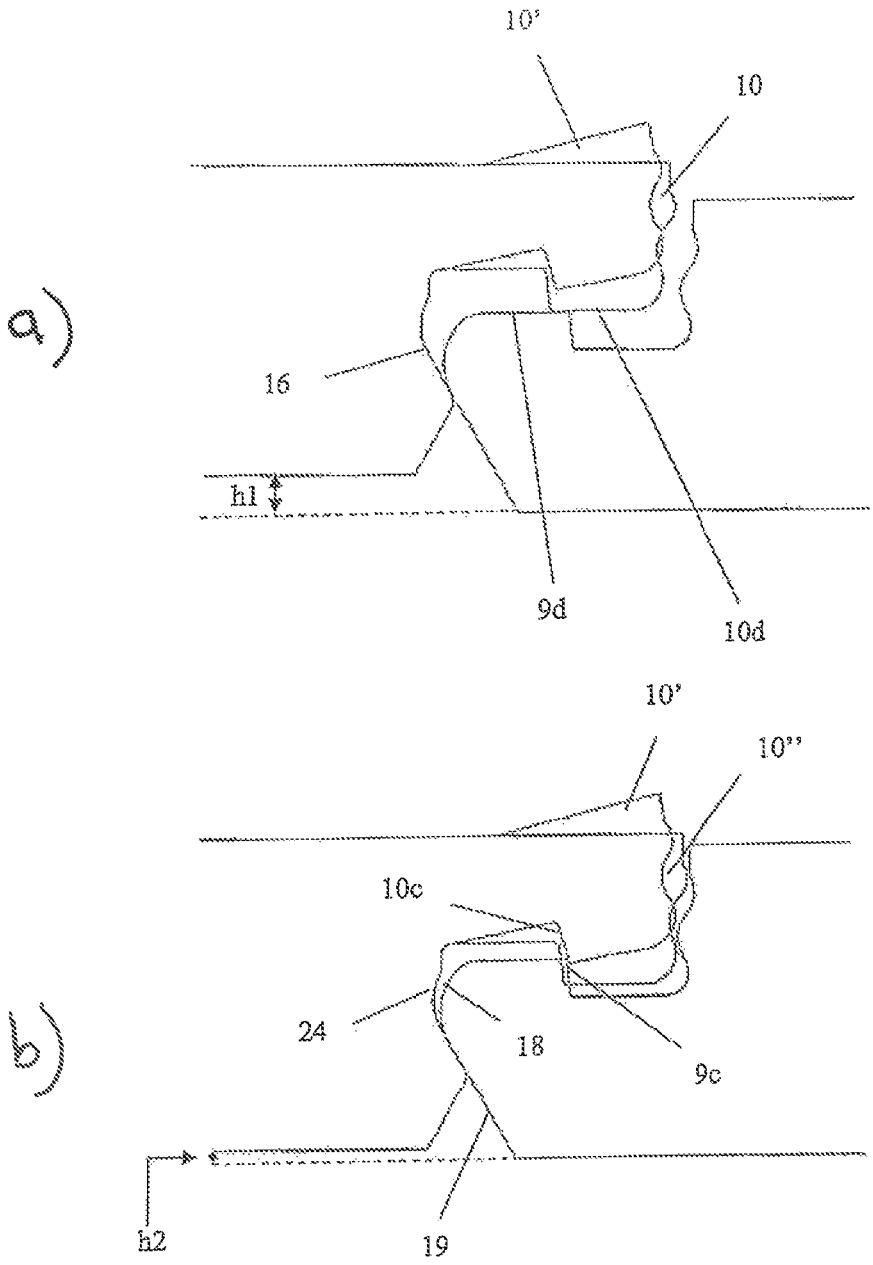
Figure 4:
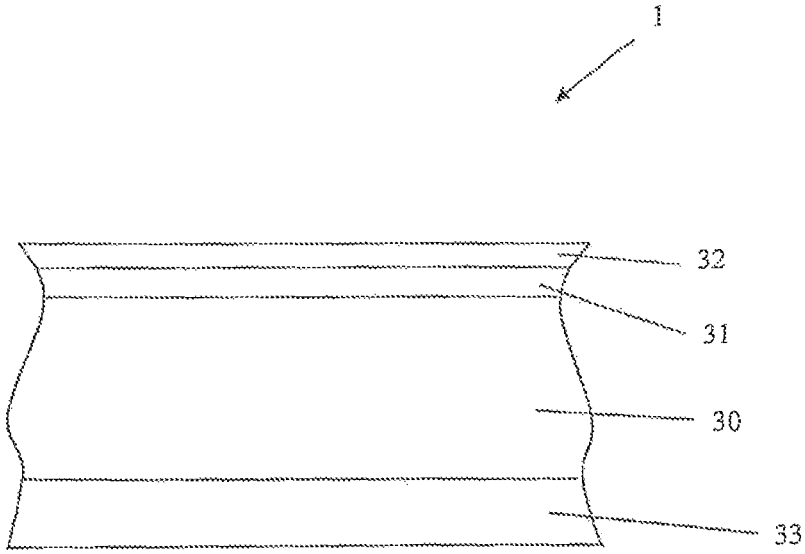

In the following the invention will be explained in more detail with reference to the attached drawings in which it is shown by:

FIG. 1 a top view of a floor panel 1, with a view to its upper face;

FIGS. 2*a, b* partial sectional views including two complementary hook-type profiles;

FIGS. 3*a, b* partial sectional views including two complementary hook-type profiles, in different situations during the joining process; and FIG. 4 the exemplary layer structure of a floor panel according to the invention.

The described floor panels according to the invention have a tabular, rectangular shape, see FIG. 1, with pairs of opposite lateral edges 3, 4 respectively 5, 6 being formed, each of which having complementary holding profiles, which are not shown for the sake of simplification of the illustration in FIG. 1. The lateral edges are provided for the connection of several similar floor panels 1.

FIG. 2*a* shows a schematic partial sectional view of a panel in which mainly the hook-type profile having the locking hook is shown, which faces the lower face 7 of the panel. The locking hook 10 has a web 10*a* that extends from the panel body, and on the outer end of the web a hook-type protrusion 10*b* is provided, which extends downwardly in the direction toward the lower face 7 of the panel. The locking hook 10 has a distal side face 11, i.e. a surface of the hook-type profile which is arranged distally with respect to the panel body. Furthermore, a proximal lateral face 15 of the hook-type profile having the locking hook is shown, i.e. a lateral face of the hook-type profile which is arranged close to the panel body. On the distal lateral surface 11 that extends vertically to the panel surface and parallel to the lateral edge, two locking protrusions 12, 13 are disposed, with a locking pocket 14 being located in between. The inner undercut surface 10*c* of the locking hook extends at an acute angle of only a few degrees to vertical of the panel surface.

The proximal lateral face 15 of the hook profile also includes a guide surface 16 that is inclined at an angle with respect to the panel surface.

FIG. 2*b* shows the lateral edge opposite the lateral edge shown in FIG. 2*a* which includes the complementary hook-type profile having the receiving hook 9 that faces the top face 2 of the panel. This hook also includes on its distal lateral face a locking protrusion 18 and a guide surface 19 that is inclined at an angle with respect to the panel surface. Also the receiving hook 9 has a web 9*a* and a hook-type protrusion 9*b* that extends toward the top face 2 of the panel. In the hook-type profile shown in FIG. 2*b* and having the receiving hook, the proximal lateral face 20 of the profile includes a locking protrusion 21 and two locking pockets 22, 23.

The complementary hook-type profiles shown in the FIGS. 2*a*, 2*b*, serve for producing a form-fit locking condition of two adjacent panels, which will be explained in the following with reference to the FIGS. 3*a, b*. These Figures respectively illustrate the hook-type profiles shown in the FIGS. 2*a, b* and comprising the locking hook in two different stages of joining of the hook-type profile during the joining and locking process. In contrast, for the sake of clarity of the illustration, the respective receiving profile, i.e. the profile having the receiving hook, is shown in only one joining position.

The initial point of the joining process of the panels or profiles is the situation shown in FIG. 3*a*, in which the right panel whose receiving profile is shown, is already installed in the installation plane. Now the new panel to be installed, i.e. the panel shown to the left in the partial sectional view and provided with the locking hook, is placed with its hook-type profile onto the hook-type profile of the already installed panel. Thus a situation is produced in which the locking hook of the left panel is in a position corresponding to the hook which is illustrated in FIG. 2*a* and indicated by reference number 10. As it can be seen, the end face 10*d* of the hook-type protrusion 10*b* is supported on the end face 9*d* of the hook-type protrusion 9*b*. The two holding profiles which are supported on one another are at the same time arranged and configured in such a manner that the guide surface 19 in this situation of the joining process has just come into contact with the distal lateral face of the receiving hook comprising the guide surface 16 on the proximal lateral face of the locking hook holding profile. As shown in FIG. 3*a*, the two panels are arranged parallel to each other, but offset by the distance h1.

In the next step of the installation process, the new panel to be installed, i.e. the panel shown to the left in FIG. 3*a*, is moved along the surface 19 of the receiving hook, i.e. in both the radial and vertical directions to the panel surface. The locking hook 10 must consequently evade upwards, which is ensured by the elastic properties of the plastic material of the support. By the described joining movement, the two panels to be locked are moved one toward the other along their adjacent lateral edges. In FIG. 2*a*, a joining position 10' of the locking hook is shown. As already explained above, the second joining position of the already installed panel, i.e. the right panel in FIG. 3*a*, is not shown for the sake of clarity of illustration. It is referred instead to FIG. 3*b* showing two joining positions 10', 10" of the locking hook during the joining process, but only one joining position for the receiving hook of the already installed panel. This approximately corresponds, however, to the joining position illustrated in FIG. 3*a* in which the locking hook assumes the position identified by reference number 10'. As it can be seen in FIG. 3*b*, at this point of time the undercut surface 9*c* of the receiving hook and the undercut surface 10*c* of the locking hook are just coming into contact with each other. In this situation of the joining process, the extent of the mutual contact of the complementary guide surfaces 16/19 has increased compared to the above-described initial situation, with the consequence that the horizontal distance h2 of the two panels to be joined is reduced compared to h1.

Thereafter, the left panel is continued to be displaced vertically and in an inclined fashion, i.e. along the guide surface 19 of the already installed panel, so that a joining position is produced with respect to the locking hook which is indicated at pos. 10". As it can be seen, in this position the joining process is almost completed. On the continued joining movement, the locking protrusions 12, 13 are finally completely received in the respective locking pockets 22, 23 and the locking protrusion 18 on the receiving hook is received in the locking pocket 24, respectively, which is arranged on the proximal lateral face 16 of the hook profile that comprises the locking hook 10 (see FIG. 2*a*). Thus the desired gap-free locking state of the panels positioned with their lateral edges comprising the complementary hook profiles adjacent to each other is achieved.

To make sure that the joining and locking process is finally completed and that the locking protrusions 12, 13, 18, 21 are locked in their associated locking pockets, it can be expedient if in the joining position according to FIG. 3*b* (locking hook 10" and/or 10') a pressure is applied from the top face 2 of the panel on the locking hook 10', 10" using a kind of roller device such as a wallpaper pressing roller, thus assisting the locking procedure.

As described, the inventive design of the complementary hook profiles on two associated lateral edges of the panel enables easy joining and locking of the panel while utilizing a given elasticity that can be substantially provided by the elastic support of the panels. After the completion of the joining and locking process, the panels are locked to each other in a form-fit fashion both vertically to the panel surface and vertically to their adjacent lateral edges.

Figure 2:
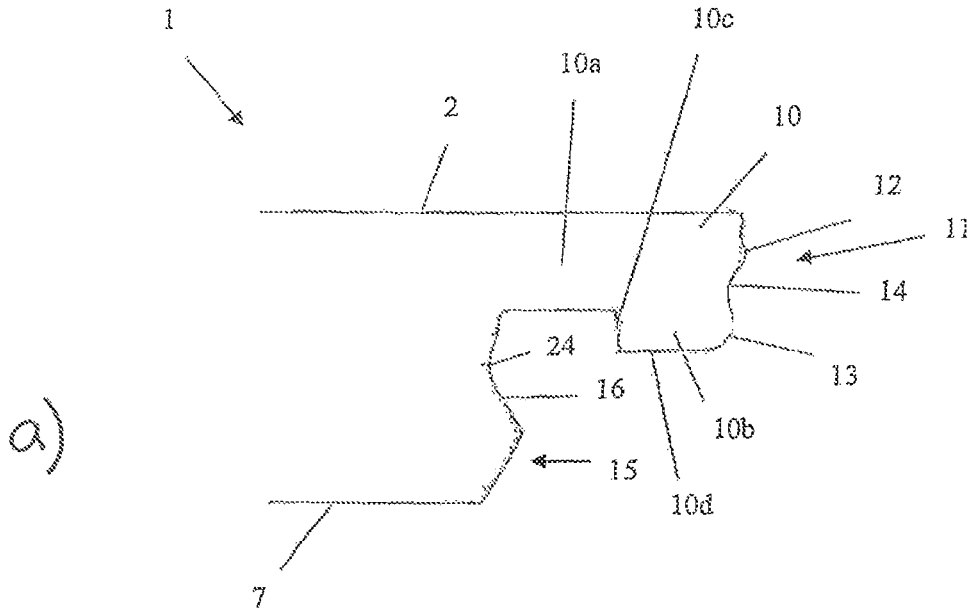
Figure 2:
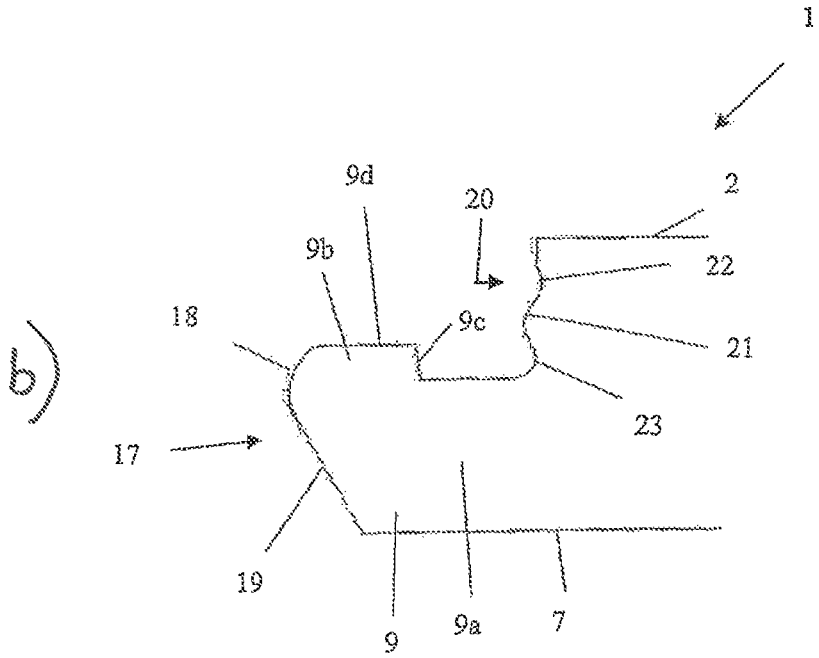

Depending on the form of execution of the invention, the holding profiles of one pair of lateral edges or of both pairs of lateral edges can be designed in the manner as shown in the FIGS. 2, 3. In the first-mentioned case, the second pair of lateral edges can be designed with respect to its holding profiles as an undercut groove-and-tongue profile. Since with this profile, joining and locking takes place by obliquely applying a new floor panel with its lateral edge against a lateral edge of an already installed panel and by subsequently pivoting the new panel down to the plane of the already installed panel, the other two mutually opposite lateral edges that comprise the hook profiles shown in the FIGS. 2*a, b* and 3*a, b* are automatically co-locked, as the same mainly require a vertical joining movement. As a result, the hook profiles are interlocked in the manner of a zipper, i.e. locking is not performed simultaneously over the entire lateral edge, but joining and locking takes place on one end of the edge and then gradually proceeds over the entire edge length to the other end.

However, if both pairs of lateral edges are provided with the hook-type profiles shown in the FIGS. 2*a, b* and 3*a, b*, the installation is different from the above-described installation. In this case, the new panel can be aligned parallel to, but horizontally spaced from the installation plane. Then the locking hook profile is, as illustrated in FIG. 3*a* (locking hook 10), placed onto the receiving profile along the entire respective lateral edge, and thereafter the joining and locking movement is performed as already described, in which particularly the surface 19 on the receiving hook profile and the surface 16 on the locking hook profile are moved toward each other. In this case, too the actual locking can be performed in the manner of a zipper.

If both pairs of lateral edges are provided with the hook profiles shown in the FIGS. 2*a, b* and 3*a, b*, the new panel can first be aligned also non-parallel with respect to the installation plane and can thus be placed with its locking hook profile in an inclined fashion onto the receiving profile of the already installed panel, and thereafter the described joining and locking movement can be performed in which particularly the surface 19 an the receiving hook profile and the surface 16 on the locking hook profile are moved toward each other. Also in this process, joining and locking is not performed simultaneously over the entire respective lateral edge, but it is rather performed in the manner of a zipper.

FIG. 4 shows in a cross section which is not true to scale the exemplary internal structure of the panel 1. The supporting element is a plastic support 30 comprising a décor layer 31, e.g. in the form of a printed film, to which a covering layer 32, e.g. in the form of an additional film or lacquer, is applied. To the lower face of the plastic support 30 a backing layer 33 is applied, in order to ensure flatness of the floor panel according to the invention. Depending on the décor, the décor layer may exhibit the reproduction of a stone décor, wood décor or an abstract pattern. To make the floor panel durable, the cover layer is highly resistant to wear due to the admixture of abrasive substances. In the described embodiment, the thickness of the plastic core amounts to 2.8 mm, the thickness of the décor layer together with the cover layer to approximately 0.2 mm, and that of the backing layer to 1 mm.

In an embodiment which is not illustrated, it can also be provided for the lower face of the plastic support 30 to be provided with a damping layer, particularly a footfall sound absorption, in addition to the backing layer. In certain circumstances, a single layer can also perform both functions.

LIST OF REFERENCE NUMBERS

1 panel
2 top face of the panel
3, 4 pair of short lateral edges
5, 6 pair of long laterals edges
7 lower face of the panel
9 receiving hook
9*a* web
9*b* hook-type protrusion
9*c* undercut surface of the receiving hook
9*d* end face of the hook-type protrusion
10, 10', 10" locking hook
10*a* web
10*b* hook-type protrusion
10*c* undercut surface of locking hook
10*d* end face of hook-type protrusion
11 distal lateral face of locking hook
12, 13 locking protrusion of locking hook
14 locking pocket of locking hook
15 proximal lateral face of locking hook profile
16 guide surface
17 distal lateral face of receiving hook
18 locking protrusion
19 guide surface
20 proximal lateral face of receiving hook profile
21 locking protrusion
22, 23 locking pocket
24 locking pocket
30 plastic support/plastic core
31 décor layer
32 covering layer
33 backing layer

The invention claimed is:

1. A pair of floor panels comprising:
a first floor panel and a second floor panel,
each of the first and second floor panels having at least one plastic support layer having a top face and a lower face;
a décor layer on the top face of plastic the support layer;
a transparent cover layer on top of the décor layer;
two pairs of opposite lateral edges;
each pair of the two pairs of opposite lateral edges having complementary holding profiles;
at least one of the complementary holding profiles being locking complementary hook profiles;
one of the locking complementary hook profiles having a receiving hook having an undercut surface which faces the top face;
the other of the locking complementary hook profiles having a locking hook having an undercut surface which faces the lower face;
a snap-in element on a distal lateral face of the locking hook;
a complementary snap-in element on a proximal lateral face of the one of the locking complementary hook profiles having the receiving hook;
a downwardly, inwardly, inclined contact and guide surface on a distal lateral face of the receiving hook, the downwardly, inwardly, inclined contact and guide surface of the receiving hook being a flat surface that extends downwardly, inwardly and inclined to the lower face; and
a complementary contact and guide surface on a proximal lateral face on the other of the locking complementary hook profiles having the locking hook, such that the downwardly, inwardly, inclined contact and guide surface of the one of the locking complementary hook profiles having the receiving hook panel contacts and guides the complementary contact and guide surface on the other of the locking complementary hook profiles of the first panel during first establishment of closure between the locking complementary holding profiles of the first and second panel.

2. The floor panels of claim 1, wherein the receiving hook of each of the first and second panels comprises, on the distal lateral face, a locking element that is associated with a complementary locking element on the proximal lateral face of the other of the locking complementary profiles having the locking hook.

3. The floor panels of claim 1 wherein the snap-in element and the complementary snap-in element of each of the first and second panels are a locking protrusion or a locking pocket for receiving the locking protrusion.

4. The floor panels of claim 1, wherein the undercut surfaces of each of the first and second panels are effective as a mutual guide surface during the establishment of the closure between the complementary holding profiles of the first and second panels, wherein both undercut surfaces extend at an acute angle with respect to a vertical of the panel surface.

5. The floor panels of claim 1, wherein the distal lateral face of the receiving hook of each of the first and second panels has a locking protrusion and a locking pocket for the receiving the locking protrusion is on the proximal lateral face of the other of the locking complementary hook profiles having the locking hook.

6. The floor panels of claim 1, wherein each pair of complementary holding profiles of each of the first and second panels are locking complementary hook profiles.

7. The floor panels of claim 1, wherein the other of the complementary holding profiles of each of the first and second panels is a complementary undercut groove-and-tongue profile.

8. The floor panels of claim 1, wherein the décor layer of each of the first and second panels comprises a printed décor film.

9. The floor panels of claim 1, wherein the décor layer of each of the first and second panels is directly printed on the plastic support.

10. The floor panels of claim 9, wherein prior to printing, the plastic support of each of the first and second panels is provided with an intermediate layer in the form of a lacquer or primer.

11. The floor panels of claim 1, wherein the transparent cover layer of each of the first and second panels comprises two partial layers in the for of one layer having a high abrasion resistance and one lacquer layer that forms a top surface of the panel.

12. The floor panels of claim 1, wherein the cover layer of each of the first and second panels comprises a single, substantially homogenous layer of high abrasion resistance.

13. The floor panels of claim 1, wherein a backing layer of each of the first and second panels comprises one or more layers selected from the group consisting of a lacquer layer and a plastic film.

14. A process for installing and locking floor panels, comprising:

providing the pair of floor panels according to claim 1, comprising the first floor panel and the second floor panel according to claim 1, installing the second floor panel in an installation plane;

locking the first floor panel at one of the lateral edges having the other of the locking complementary profiles having the locking hook thereof to one of the lateral edges the second floor panel having the one of the locking complementary hook profiles having the receiving hook by placing the locking hook onto the receiving hook thereby contacting the contact and guide surface of the one of the locking complementary hook profiles having the receiving hook of the second floor panel with the complementary contact and guide surface of the other of the locking complementary hook profiles having the locking hook of the first floor panel such that the locking hook of the first floor panel is supported on the receiving hook of the second floor panel and the first floor panel is inclined with respect to the installation plane and the top face of the second floor panel;

bending and pivoting the locking hook of the first floor panel out of a plane of the top face of the first floor panel enabling the undercut surface of the locking hook of the first floor panel to come into contact with the undercut surface of the receiving hook of the second floor panel.

15. The process of claim 14, further comprising applying a substantially vertical force on the top face of the first floor panel, such that the first floor panel is displaced in an inclined fashion relative to the second floor panel along contact and guide surface in the region of the holding profile.

16. The process of claim 15, wherein the step of applying a vertical force on the locking hook is performed using a pressure roller.

17. The process of claim 14, further comprising:

applying a force on the locking hook vertically to the installation plane, such that the snap-in element on the distal lateral face of the locking hook of the first floor panel co-acts in an interlocking fashion with the complementary snap-in element on the proximal lateral face of the one of the locking complementary hook profiles of the second floor panel in such a manner that the locking hook is pivoted back to the plane of the top face of the first floor panel and locked in the installation plane.

* * * * *